United States Patent [19]

Stahlecker

[11] Patent Number: 4,858,422

[45] Date of Patent: Aug. 22, 1989

[54] SUCTION ROLLER ARRANGEMENT FOR AN OPEN END FRICTION SPINNING MACHINE

[75] Inventor: Fritz Stahlecker, Bad Üeberkingen, Fed. Rep. of Germany

[73] Assignee: Hans Stahlecker, Fed. Rep. of Germany

[21] Appl. No.: 9,089

[22] Filed: Jan. 27, 1987

Related U.S. Application Data

[63] Continuation of Ser. No. 607,275, May 4, 1984, abandoned.

[30] Foreign Application Priority Data

May 6, 1983 [DE] Fed. Rep. of Germany ..... 3316656

[51] Int. Cl.[4] ..... D01H 7/882; D01H 7/892

[52] U.S. Cl. ..... 57/401; 57/411

[58] Field of Search ..... 57/400, 401, 406, 408, 57/411, 415

[56] References Cited

U.S. PATENT DOCUMENTS 3,913,310 10/1975 Fehrer ..... 57/401
4,168,601 9/1979 Didek et al. ..... 57/401
4,315,398 2/1982 Parker et al. ..... 57/401
4,380,892 4/1983 Parker et al. ..... 57/401

FOREIGN PATENT DOCUMENTS 339778 2/1977 Austria .

*Primary Examiner*—John Petrakes
*Attorney, Agent, or Firm*—Barnes & Thornburg

[57] ABSTRACT

A suction insert assembly is disclosed for a suction roller of an open spinning unit having a pair of rotatably driven friction rollers defining a yarn forming wedge-shaped gap or slot therebetween.

To accommodate ease of manufacture and provide variable adjustment of the suction effect at the wedge slot, the suction insert assembly for at least one of the friction rollers includes a pipe fitted to the machine frame, and an intermediate piece filling out the space between the pipe and the perforated friction roller shell. The pipe is connected to a vacuum line and has a pipe slot communicating with an intermediate slot of the intermediate piece. The pipe rotatably supports the perforated shell by roller bearings located near the pipe ends.

33 Claims, 2 Drawing Sheets

Fig. 1
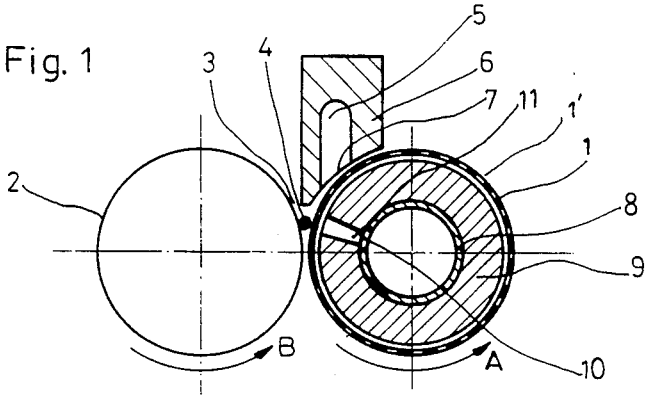
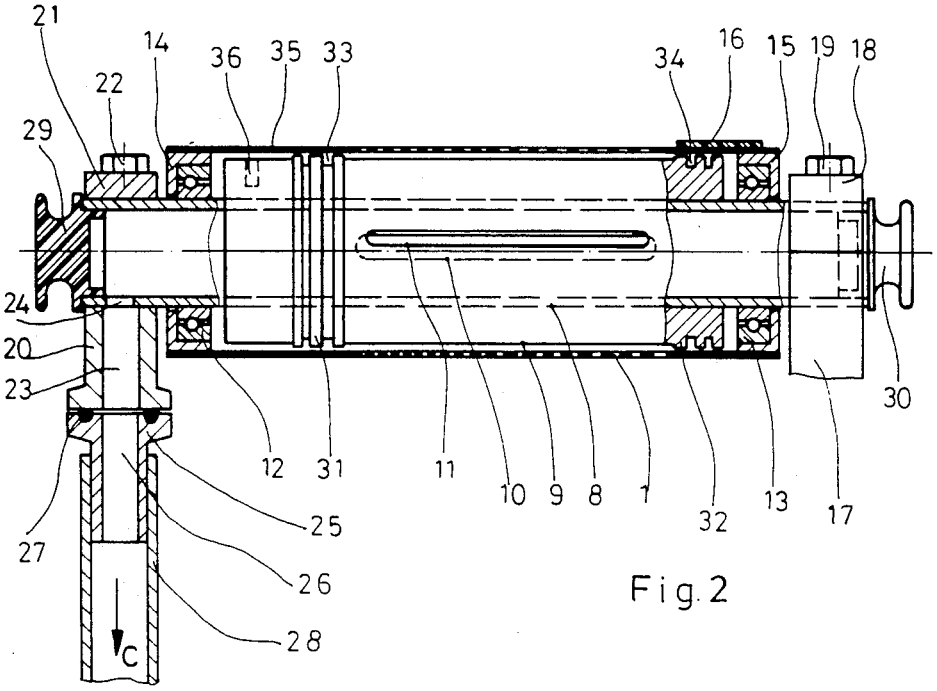
Fig. 2

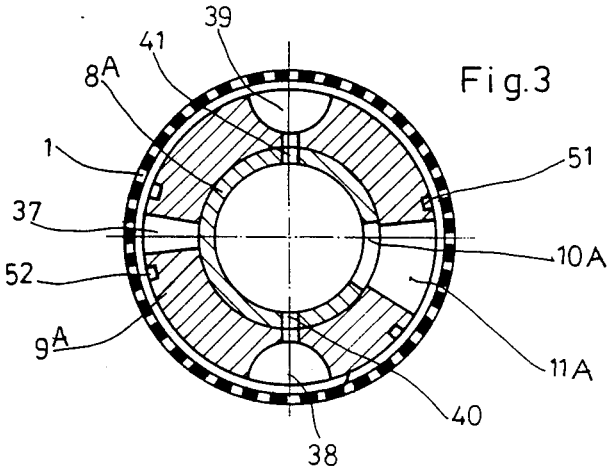
Fig.3
Fig.4
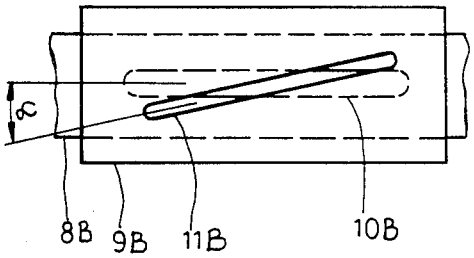
Fig.5
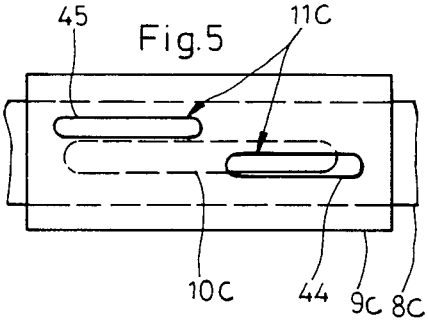
Fig. 6
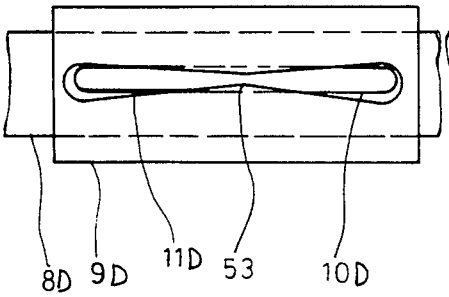
Fig. 7
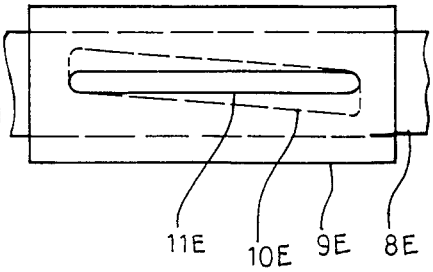

SUCTION ROLLER ARRANGEMENT FOR AN OPEN END FRICTION SPINNING MACHINE

This is a continuation of application Ser. No. 607,275, filed May 4, 1984, now abandoned.

BACKGROUND AND SUMMARY OF THE INVENTION

This invention relates to an arrangement for open end friction spinning machines of the type having two friction rollers that are arranged adjacent to one another to form a wedge-shaped yarn forming gap therebetween and which rollers are driven in the same rotational direction. At least one of the friction rollers has a perforated shell, on the inside of which a suction insert is arranged that is connected to a vacuum pipe, said suction insert exhibiting a suction slot directed to the area of the wedge-shaped gap.

In the case of a known device of the above-mentioned type disclosed in Published European Patent Application (EP-OS) 52 412, a tube shaped suction insert is disposed with its exterior wall so that it is close to the inside surface of the perforated roller shell and is provided with a suction slot which is aimed at the wedge-shaped gap. Another interior insert which has a slot extending diagonally to the suction slot is provided within the suction insert and is arranged so that it can be turned. Through the rotation of the interior insert, the suction slot can be closed progressively in the axial direction. In the case of the known design, this facilitates the return of a thread end into the spinning aggregate for a start spinning process. The relative position of the suction slot with respect to the wedge-shaped gap and the suction effect exercised by it during the normal spinning operation are not adjustable. In order to be able to house and actuate the rotatable interior insert within the suction insert, a very expensive construction is provided which also results in an expensive mounting or bearing for the shell of the roller.

The present invention provides for a simplified construction of an open-end friction spinning machine of the above-mentioned type, where the relative position of the suction slot with respect to the wedge-shaped gap and/or the resultant suction effect can be adjusted precisely and, as necessary, can be changed to adapt to changed spinning conditions. Thus, the preferred embodiments of the invention provide for differential friction effect and adjustment thereof at different axial sections of the fiber feeding zone.

This objective is achieved according to the invention by providing that the suction insert is formed by a pipe that is held fast with respect to rotation and is connected to a vacuum pipe and an intermediate connection piece that essentially fills the space between the shell and the pipe. The intermediate connection piece has a suction slot that is communicated with the inside space of the pipe and is arranged on the pipe so that it can be adjusted in the circumferential direction and/or the axial direction, said pipe serving as the shaft for one or several roller bearings supporting the perforated friction roller shell, which shell is driven directly by a belt drive. In preferred proposed commercial embodiments, the belt drive will drive a plurality of friction roller shells arranged at respective separate spinning units on any spinning machine frame.

The development is constructively very simple, especially for the mounting and the drive of the friction rollers. The arrangement additionally advantageously accommodates a simple manner of adjustment of the relative position of the suction slot with respect to the wedge-shaped slot and/or its suction effect (i.e., the direction and/or magnitude of the suction air flow), if necessary, to adapt to changed spinning conditions.

In the case of an especially simple preferred embodiment, the suction insert is formed by a cylindrical pipe or tube and a pipe-shaped cylindrical intermediate piece is fitted by sliding it onto the pipe. A slot-shaped connection opening to the suction slot of the cylindrical intermediate piece, provided on the pipe. The mounting of the perforated roller shell on the pipe is preferably via roller bearings of the same size as the inside of the shell, which arrangement is advantageous for the stressing and bearing loads and especially for accomodating series production. In this case, it is advantageous if the intermediate piece is made of plastic. This allows especially narrow tolerances to be maintained, with respect to the interior surface of the shell, since a possibly occuring slight touching of the intermediate piece by the shell would not result in any damage.

In a useful development of the invention, it is provided that the cylindrical pipe projects beyond the ends of the shell which, in the area of its two ends, is mounted on the pipe by roller bearings, so that the intermediate piece is arranged between the roller bearings. Thus, the intermediate piece also serves as a seal between the area of the vacuum, namely the suction slot, and the roller bearings. In this case, it is especially advantageous if the pipe-shaped intermediate piece is provided on its exterior surface with annular grooves and/or torri sealing its suction slot with respect to the roller bearing or roller bearings. Thus, at certain points, very narrow sealing gaps can be maintained, while in addition, a type of labyrinth seal is created. For the same purpose, it is also advantageous if the suction slot of the intermediate piece is bounded by at least one groove extending in parallel to its contour. Here, also in the manner of a labyrinth packing the suction effect resulting from the suction slot is limited with respect to area. In order to be able to adjust the intermediate piece, it is advantageous for the shell to be provided with an access recess located in axial direction outside the area of the suction slot of the intermediate piece, the intermediate piece being provided with a working surface for a tool in the area of this access recess.

In another development of the invention, the intermediate piece is provided with at least one recess extending approximately over the perforated area of the shell and being open in the direction of the shell, said recess being spaced from the suction slot. This recess collects particles, such as fiber residues or dust that enter between the shell and the connection so that they do not interfere with the spinning operation. This recess must then be cleaned during a maintenance procedure. In a useful further development, it is provided that the recess of the intermediate piece is connected with the inside of the pipe, via openings. In this case, deposits can be sucked out of the recess of the intermediate piece and can be removed.

Further objects, features, and advantages of the present invention will become more apparent from the following description when taken with the accompanying drawings which show, for purposes of illustration only, embodiments in accordance with the present invention.

BRIEF DESCRIPTION OF THE DRAWINGS

FIG. 1 is a cross sectional view through a portion of an open-end friction spinning unit having at least one friction roller formed as a perforated suction roller;

FIG. 2 is a longitudinal sectional view through the suction roller of FIG. 1;

FIG. 3 is a cross sectional view through another preferred embodiment of a suction roller constructed in accordance with the present invention; and FIGS. 4 to 7 are diagrammatic representations of various further preferred embodiments of suction inserts, consisting respectively of a pipe and of an intermediate piece slipped onto it, for suction rollers constructed according to the present invention.

DETAILED DESCRIPTION OF THE DRAWINGS

In order not to obscure the present invention, in the drawings and the following description, only those features of an open end friction spinning machine are illustrated and described that are deemed necessary to enable one skilled in the art to practice the invention. It will be understood by those skilled in the art of open end friction spinning that each spinning unit includes a pair of friction rollers such as depicted schematically in FIGS. 1, means for feeding opened fibers to the fiber feeding duct 5, and means for drawing off spun yarn formed in the wedge slot or gap between the friction rollers.

Referring to FIG. 1 and 2, friction rollers 1' and 2 are arranged in parallel next to one another, rollers 1' and 2 form a wedge-shaped gap 3 and are driven in the direction of the Arrows A and B, with roller 1' being constructed as a so-called suction roller assembly. Roller assembly 1' has a shell 1 that is perforated over a certain part of its axial length, a suction insert being arranged on the inside of said shell 1. The second roller 2, of which only the contour is schematically shown, may also be constructed as a suction roller. Alternatively, roller 2' may be constructed as a closed roller that, as desired, may be provided with a covering or a profiling.

Fibers that are opened up into individual fibers are led to the wedge-shaped gap 3 via a fiber feeding duct 5 of a housing 6, the mouth 7 of which duct 5 is arranged at a short distance from the wedge-shaped gap 3 opposite the rotating direction of the shell 1 rotating into the wedge-shaped gap 3, so that the fed fibers first meet the shell 1 and are transported by the shell into the wedge-shaped gap 3, where they are twisted together into a yarn or thread 4. The yarn 4, in a manner that is not shown in detail, is drawn off in the longitudinal direction of the wedge-shaped gap 3 by means of at least one driven pair of draw-off rollers.

The transport of the fibers into the fiber feeding duct 5 takes place by a transport air current which is generated in the fiber feeding duct 5 essentially by a vacuum existing in the area of the wedge-shaped gap and of the mouth 7 of the fiber feeding duct 5. The vacuum is generated via suction insert 8, 9 arranged on the inside of shell 1, said suction insert 8, 9 being connected to a vacuum pipe (FIG. 2).

As shown especially in FIG. 2, shell 1 is mounted on a constant diameter cylindrical pipe 8 in the area of its ends by means of two roller bearings 12 and 13. For the sealing of the roller bearings 12 and 13 toward the outside, angular intermediate rings 14 and 15 are provided between the outer bearing ring and the shell 1 which, with a slight play, face the outer surface of pipe 8. Pipe 8 which, by means of its ends, projects beyond the two ends of the shell 1 toward the outside, is mounted in housings 17 and 20 so it cannot be twisted. Housings 17 and 20 are provided with shell-shaped receiving means into which pipe 8 is inserted. Pipe 8 is clamped in these receiving means by clamping pieces 18 and 21 which are tightened against housings 17 and 20 by screws 19 and Pipe 8 is provided at one end with cross hole 24 which is connected via duct 23 of housing 20 to connection 25 provided with channel 26, said connection 25 being connected to vacuum pipe 28. A sealing ring 27 is provided between housing 20 and connection 25. Both ends of pipe 8 are closed by plugs 29 and 30 so that a vacuum is generated via vacuum pipe 28 on the inside of pipe 8.

Pipe-shaped intermediate piece 9 is arranged on pipe 8, essentially filling the space between pipe 8 and the inner surface of shell 1, between roller bearings 12 and 13. Intermediate piece 9, which in especially preferred embodiments is advantageously made of plastic, is provided with suction slot 11 which, in the case of the embodiment according to FIGS. 1 and 2, extends parallel to a generating line (i.e., a line parallel to the longitudinal axis) of shell 1, pipe 8 or intermediate piece 9 over the length of the perforated area of shell 1. Suction slot 11 is connected with the inside of pipe 8 via slot-shaped connection opening 10.

As shown in FIGS. 1 and 2, pipe 8 is clamped firmly so that connection opening 10 which in circumferential direction is wider than suction slot 11, is aimed approximately at the area of the wedge-shaped gap 3. The relative position of suction slot 11 with respect to wedge-shaped gap 3 and mouth 7 of fiber feeding duct 5 is determined by the position of pipe-shaped intermediate piece 9 which can be moved on pipe 8 in the axial direction and/or can be rotated in the circumferential direction. In order to be able to twist intermediate piece 9, shell 1, at a certain axial distance from suction slot 11, is provided with recess 35 which is arranged in the area of tool accomodating surface 36, for example, a radial borehole in intermediate piece 9. If necessary, a setscrew is screwed into radial borehole 36, said setscrew contacting pipe 8 and fixing intermediate piece 9 in the adjusted position.

As shown especially in FIG. 2, the adjustment of the intermediate piece 9 can result in the adjustment of the relative position of the suction slot 11 with respect to the wedge-shaped gap 3. In this case, it is also possible to influence the suction effect on the area of the wedge-shaped gap by twisting the intermediate piece 9 with respect to the pipe 8 in such a way that only a small cross section of the connection opening 10 is effective.

In order to seal off the suction effect in the area of the suction slot 11 with respect to the roller bearings 12 and 13, it is provided in the case of the embodiment according to FIGS. 1 and 2 that the intermediate piece 9 is provided with annular rings 31 and 32 as well as with ring grooves 33 and 34 located in between, which separate the area of the roller bearings 12 and 13 from the area of the suction slot 11. In the area of the annular rings 31 and 32, relatively narrow sealing gaps are maintained with respect to the inside surface of shell 1.

As FIG. 2 shows, the drive of the two rollers takes place by means of a tangential belt 16 which runs directly against the shell 1 and also against the shell of the roller 2 in the area of the roller bearing 13.

In the case of the embodiment according to FIG. 3, where only one of the two rollers of a device for open-end friction spinning is shown, a suction insert is provided which includes a cylindrical pipe 8A and an essentially cylindrical intermediate piece 9A is provided within the shell 1, which has two suction slots 11A and 37 which can be used selectively by twisting the intermediate piece 9A over the connection opening 10A. These two suction slots 11A and 37 have a varying form, as shown in FIG. 3 by the varying width in circumferential direction. Other embodiments are also contemplated with more than two suction slots in the intermediate piece 9A, which can be used selectively in order to adapt the device to varying spinning conditions. In order to limit the suction effect of the suction slots 11A and 37 essentially also to their area, these suction slots 11A and 37, on their side that faces the inside surface of the shell 1, are bounded by grooves 51 and 52 that surround it in parallel to the edge of the suction slots 11A or 37. In this case, it can be sufficient not to form the grooves 51 and 52 so that they completely surround the suction slots 11A and 37 but only along the edges limiting the suction slots 11A and 37 in the circumferential direction.

In practice, it is unavoidable that dirt, such as dust and possible residues of fibers, penetrates through the perforation of the shell 1 and reaches the space between shell 1 and intermediate piece 9. To prevent impairment of the running of shell 1, intermediate piece 9A is provided with recesses 38 and 39 extending at least over the perforated area of the shell in the axial direction, where this dirt can be collected and deposited. During a maintenance procedure, for example, when repairing a thread breakage, these recesses 38 and 39 must then be cleaned, for example, by means of pneumatic suction devices. It is also contemplated to continuously discharge the dirt collected in these recesses 38 and 39 by providing connection openings 40 and 41 between the recesses 38 and 39 and the inside space of the pipe 8A, via which a continuous sucking-off takes place. These connection openings 40 and 41 on the one hand, must be large enough to prevent clogging, but on the other hand, must be so small that the air requirement is not increased inappropriately.

By means of the axial shifting and/or twisting in circumferential direction of intermediate piece 9, 9A with respect to pipe 8, 8A as well as by the basic adjustment of pipe 8, 8A, the position of suction slot 11, 11A in relation to the wedge-shaped gap 3 and the mouth 7 of the fiber feeding duct 5 can be changed. Similarly, the suction effect may be changed by changing the open cross section in the transition between the connection opening 10, 10A of the pipe and suction slot 11, 11A. When suction slot 11 and connection opening 10 are aligned parallel to one another along a generating line of pipe 8 and intermediate piece 9 (FIG. 1), the suction effect is adjusted evenly over the whole length of suction slot 11. However, it is also contemplated to obtain varying suction effects over the axial length of suction slot 11, 11A, by providing that suction slot 11, 11A and connection opening 10, 10A have varying shapes.

In the embodiment shown in FIG. 4, connection opening 10B of pipe 8B extends in axial direction along a generating line of pipe 8B, whereas suction slot 11B which is narrower in the circumferential direction, is sloped at an angle $\alpha$. Depending on the adjustment in the circumferential direction, the axial location of the strongest effect of the suction pull along suction slot 11B can be adjusted. In the case of the position shown in FIG. 4, the area of the strongest effect of the suction pull is located approximately in the center of the suction slot 11B. The same adjustment can also be achieved when suction slot 11B extends in axial direction along a generating line of the intermediate piece 9 and the connection opening is sloped with respect to it. In this case the suction pull can be adjusted and proportioned for a varying effect in the axial direction, while suction slot 11B still extends in parallel to wedge-shaped gap 3.

In the embodiment shown in FIG. 5, suction slot 11C is divided into two sections 44 and 45 which are located one behind the other in the axial direction, whereas the connection opening 10C of the pipe 8C extends in the axial direction along a generating line. The two sections 44 and 45 are staggered with respect to one another in the circumferential direction, in which case, the extent of the staggering is selected to be not larger than the width of connection opening 10C in the circumferential direction, so that it is possible to connect both sections 44 and 45 via connection opening 10C, to the vacuum source simultaneously.

In the embodiment shown in FIG. 6, connection opening 10D of pipe 8D extends in axial direction along a generating line. Suction slot 11D also extends in axial direction along a generating line, but in its center area has throat 53 by means of which, in this area, its cross section is decreased to a width which is smaller than the breadth of connection opening 10D, while, in its remaining area, it has a width that reaches or exceeds the width of connection opening 10. In this manner, the form of suction slot 11D does influence the distribution of the suction effect in axial direction. By the axial shifting of intermediate piece 9D or by the turning in circumferential direction, the strength of the suction effect can also be affected.

In the embodiment shown in FIG. 7, intermediate piece 9E is provided with suction slot 11E extending in axial direction along a generating line. Connection opening 10E of pipe 8E is associated with suction slot 11E, the length of which corresponds to suction slot 11E, but which is formed in the shape of a parallelogram. As shown in FIG. 7, intermediate piece 9E can be positioned over pipe 8E and adjusted such that suction slot 11E is arranged with its full width and its full length over connection opening 10E. By turning and intermediate piece 9E, it is possible to limit the overlap of connection opening 10E and suction slot 11E to a portion of the axial length of pipe 8E.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Suction insert assembly arrangement for a suction roller of an open-end spinning unit of the type having a pair of rotatably driven friction rollers disposed adjacent one another to form a yarn forming wedge-shaped gap therebetween, with at least one of the friction rollers being formed as a suction roller with a perforated shell means and a suction insert assembly disposed therein for directing suction air flow in the region of the wedge-shaped gap, said suction insert assembly comprising:

pipe means connectible to a vacuum source, said pipe means being non-rotatably supported by spinning unit support means, said pipe means including a pipe slot means communicating the outer surface of the pipe means with the vacuum source, said pipe slot means being circumferentially located approximately in the area of said wedge-shaped gap; and intermediate piece means interposed between the outer surface of the pipe means and the perforated shell means, said intermediate piece means including intermediate slot means for communicating the pipe slot means to the inside surface of the perforated shell means, said intermediate piece means being adjustably mounted at the pipe means to accommodate relative movement of the intermediate piece means with respect to the pipe means in at least one of the circumferential and axial directions to adjust at least one of either the direction or magnitude of the suction air flow occurring during a yarn forming operation.

2. An arrangement according to claim 1, wherein the perforated shell means includes belt drive surface means for accommodating driving thereof by a belt drive means engaging there against, and wherein said intermediate piece means is adjustably mounted for relative movement in both the axial and circumferential direction with respect to the pipe means.

3. An arrangement according to claim 1, further comprising rotatable bearing means for rotatably supporting the perforated shell means on the pipe means.

4. An arrangement according to claim 3, wherein the rotatable bearing means are roller bearing means.

5. An arrangement according to claim 4, wherein the roller bearing means are ball bearing means having an inner race fitted to the pipe means and an outer race fitted to a bracket means attached to the perforated sleeve means.

6. Arrangement according to claim 3, wherein the pipe-shaped intermediate piece means is provided on its outer surface with ring grooves and/or annular rings sealing off the intermediate slot means with respect to the roller bearing means.

7. An arrangement according to claim 3, wherein the pipe means is a constant diameter pipe which extends beyond both ends of the intermediate piece means to form bearing places for the roller bearing means supporting the perforated shell means.

8. An arrangement according to claim 7, wherein set screw means are provided for adjustably locking the intermediate piece means to the pipe means.

9. An arrangement according to claim 1, wherein the pipe means is a cylindrical pipe and the intermediate piece means is a cylindrical pipe-shaped intermediate piece slipped onto the pipe, wherein the pipe has a slot-shaped connection opening to a suction slot forming the intermediate slot means of the intermediate piece means.

10. An arrangement according to claim 9, wherein the cylindrical pipe projects beyond axial ends of the perforated shell means, said shell means being mounted on the cylindrical pipe by means of roller bearings at both ends of the shell with the intermediate piece means arranged between the roller bearings.

11. Arrangement according to claim 10, wherein the pipe-shaped intermediate piece means is provided on its outer surface with ring grooves and/or annular rings sealing off the intermediate slot means with respect to the roller bearing means.

12. An arrangement according to claim 1 wherein the intermediate piece means is made of plastic.

13. An arrangement according to claim 1, wherein the intermediate suction slot means of the intermediate piece means is bounded by at least one groove extending in parallel to its contour.

14. An arrangement according to claim 1, wherein the perforated shell means is provided with a recess located in axial direction outside the area of the intermediate slot means of the intermediate piece means, the intermediate piece means being provided in the area of said recess with a working surface for tools.

15. An arrangement according to claim 1 wherein the intermediate piece means is provided with at least one recess spaced from the intermediate slot means and extending approximately over the perforated area of the shell and being open in the direction of the shell.

16. An arrangement according to claim 15, wherein the recess of the intermediate piece means is connected with the inside of the pipe means via openings.

17. An arrangement according to claim 1, wherein the intermediate slot means has a shape that is different from the shape of the pipe slot means.

18. An arrangement according to claim 17, wherein the width of the pipe slot means in the circumferential direction is larger than the width of the intermediate slot means.

19. An arrangement according to claim 1, wherein the intermediate slot means includes several suction slots that differ from one another, and that can selectively be brought into alignment with the pipe slot means.

20. An arrangement according to claim 1, wherein the intermediate slot means is divided into several sections.

21. An arrangement according to claim 20, wherein the sections of the intermediate slot means have varying widths in circumferential direction.

22. An arrangement according to claim 21, wherein the sections of the intermediate slot are staggered with respect to one another in circumferential direction.

23. An arrangement according to claim 20, wherein the sections of the intermediate slot are staggered with respect to one another in circumferential direction.

24. An arrangement according to claim 1, wherein the pipe slot means is mounted so that it slopes toward a generating line of the pipe means.

25. An arrangement according to claim 1, wherein the intermediate slot means is mounted so that it slopes towards a generating line of the intermediate piece means.

26. An arrangement for open-end friction spinning of yarn comprising:

two friction rollers rotatably drivable in the same direction and disposed adjacent one another to form a yarn forming wedge-shaped gap therebetween, fiber supplying means for supplying individual fibers to a fiber feeding zone extending over a limited axial extent of the wedge-shaped gap, differential friction effect means for applying a differential friction effect to forming yarn at different axial sections of the fiber feeding zone, and adjusting means for adjusting the differential friction effect means for different operational spinning conditions, said adjusting means including means for effecting relative movement of friction roller parts to change at least one of slot size and position of suction slots extending adjacent the fiber feeding zone.

27. An arrangement according to claim 26, wherein at least one of the friction rollers is formed as a suction roller with a perforated shell means and a suction insert assembly disposed therein for directing suction air flow in the region of the wedge-shaped gap.

28. An arrangement according to claim 26, wherein said differential effect means includes means for applying different suction effects along the length of the yarn forming gap.

29. An arrangement according to claim 28, wherein said adjusting means includes means for varying the suction effect along the yarn forming gap for different operational spinning conditions.

30. An arrangement for open-end friction spinning of yarn comprising:

two friction rollers rotatably drivable in the same direction and disposed adjacent one another to form a yarn forming wedge-shaped gap therebetween, fiber supplying means for supplying individual fibers to a fiber feeding zone extending over a limited axial extent of the wedge-shaped gap.

different friction effect means for applying a differential friction effect to forming yarn at different axial sections of the fiber feeding zone, and adjusting means for adjusting the differential friction effect means for different operational spinning conditions, wherein at least one of the friction rollers is formed as a suction roller with a perforated shell means and a suction insert assembly disposed therein for directing suction air flow in the region of the wedge-shaped gap, wherein said differential friction effect means comprises:

pipe means connectible to a vacuum source, said pipe means being non-rotatably supported by spinning unit support means, said pipe means including a pipe slot means communicating the outer surface of the pipe means with the vacuum source, said pipe slot means being circumferentially located approximately in the area of said wedge-shaped gap; and intermediate piece means interposed between the outer surface of the pipe means and the perforated shell means, said intermediate piece means including intermediate slot means for communicating the pipe slot means to the inside surface of the perforated shell means, said intermediate piece means being adjustably mounted at the pipe means to accommodate relative movement of the intermediate piece means with respect to the pipe means in at least one of the circumferential and axial directions to adjust at least one of either the direction or magnitude of the suction air flow occurring during a yarn forming operation.

31. An arrangement according to claim 30, further comprising rotatable bearing means for rotatably supporting the perforated shell means on the pipe means.

32. A process for open-end friction spinning of yarn comprising:

rotatably driving a pair of adjacently arranged friction rollers forming a wedge-shaped gap therebetween in the same rotational direction, supplying fibers to a fiber feeding zone extending over a limited axial extent of the wedge-shaped gap, withdrawing spun yarn form the wedge-shaped gap, and adjusting the friction effect along the length of the wedge shaped gap for different operational spinning conditions by effecting relative movement of roller parts to change at least one of slot size and position of suction slots extending adjacent the fiber feeding zone.

33. A process according to claim 32, wherein said adjusting includes adjusting the suction effect along the length of the yarn forming gap.

* * * * *